US011817069B2

(12) United States Patent
Bliss

(10) Patent No.: US 11,817,069 B2
(45) Date of Patent: Nov. 14, 2023

(54) MUTATING SPECTRAL RESYNTHESIZER SYSTEM AND METHODS

(71) Applicant: Rossum Electro-Music, LLC, Santa Cruz, CA (US)

(72) Inventor: Robert Bliss, Soquel, CA (US)

(73) Assignee: Rossum Electro-Music, LLC, Santa Cruz, CA (US)

( * ) Notice: Subject to any disclaimer, the term of this patent is extended or adjusted under 35 U.S.C. 154(b) by 458 days.

(21) Appl. No.: 17/156,484

(22) Filed: Jan. 22, 2021

(65) Prior Publication Data

US 2021/0233504 A1 Jul. 29, 2021

Related U.S. Application Data

(60) Provisional application No. 62/965,042, filed on Jan. 23, 2020.

(51) Int. Cl.
*G10H 1/36* (2006.01)
*G10H 1/06* (2006.01)

(52) U.S. Cl.
CPC ..... *G10H 1/366* (2013.01); *G10H 1/06* (2013.01); *G10H 2250/221* (2013.01); *G10H 2250/235* (2013.01); *G10H 2250/541* (2013.01)

(58) Field of Classification Search
CPC ..... G10H 1/36
See application file for complete search history.

(56) References Cited

U.S. PATENT DOCUMENTS

| | | | |
|---|---|---|---|
| 3,268,831 | A | 8/1966 | Johannes et al. |
| 3,441,653 | A | 4/1969 | Melville, Jr. |
| 3,941,930 | A | 3/1976 | Mohri et al. |
| 4,179,969 | A | 12/1979 | Hamada |
| 4,180,707 | A | 12/1979 | Moog |
| 4,250,496 | A | 2/1981 | Southgate |

(Continued)

OTHER PUBLICATIONS

Mathews et al., "Methods for Synthesizing Very High Q Parametrically Well Behaved Two Pole Filters," Stockholm Musical Acoustic Conference (SMAC), Aug. 3 6-9, 2003, available at <https://ccrma.stanford.edu/~jos/smac03maxjos/smac03maxjos.pdf>. 10 pages.

(Continued)

*Primary Examiner* — Olisa Anwah
(74) *Attorney, Agent, or Firm* — Carr & Ferrell LLP

(57) ABSTRACT

A method of and system for generating audio having pitch attributes of an incoming audio stream. The method comprises receiving a digital audio input. The audio spectrum is analyzed and integrated over segments of digital audio data upon receiving analysis triggers which can be synced with the audio tempo. The integrated spectrum is processed to find peak frequencies in the spectrum and their associated gain stored in a peaks array. The peak frequencies are used to program the oscillators controllable attributes and characteristics. The synthesis is performed upon receiving an analysis clock. A number of digital oscillators are configured with the associated frequency parameters and gain parameters from a peaks array. The oscillators are configured according to the audio pitch analysis and generate an oscillator output at the frequency and gain specified in the peaks array. These oscillator outputs are summed together generating synthesized audio.

23 Claims, 4 Drawing Sheets

(56) References Cited

U.S. PATENT DOCUMENTS

| | | | | |
|---|---|---|---|---|
| 4,314,496 | A | 2/1982 | Beigel | |
| 4,316,401 | A | 2/1982 | Tavel et al. | |
| 4,322,995 | A | 4/1982 | Tavel | |
| 4,447,792 | A | 5/1984 | Wynn | |
| 5,157,623 | A | 10/1992 | Hayashi | |
| 5,170,369 | A | 12/1992 | Rossum | |
| 5,414,210 | A | 5/1995 | Sato | |
| 5,574,792 | A | 11/1996 | Konno | |
| 5,668,338 | A * | 9/1997 | Hewitt | G06F 3/162 84/629 |
| 6,504,935 | B1 | 1/2003 | Jackson | |
| 6,664,460 | B1 | 12/2003 | Pennock et al. | |
| 7,638,704 | B2 | 12/2009 | Ludwig | |
| 9,514,727 | B2 | 12/2016 | Liptac | |
| 9,552,826 | B2 | 1/2017 | Kimura et al. | |
| 10,514,883 | B2 | 12/2019 | Rossum | |
| 11,087,732 | B2 | 8/2021 | Rossum | |
| 11,202,147 | B2 | 12/2021 | Rossum | |
| 2005/0190930 | A1 | 9/2005 | Desiderio | |
| 2006/0145733 | A1 | 7/2006 | Leary et al. | |
| 2009/0164905 | A1 | 6/2009 | Ko | |
| 2014/0053710 | A1 * | 2/2014 | Serletic, II | G09B 15/04 84/609 |
| 2014/0053711 | A1 * | 2/2014 | Serletic, II | G09B 15/04 84/613 |
| 2015/0317966 | A1 | 11/2015 | Liptac | |
| 2018/0239578 | A1 | 8/2018 | Rossum | |
| 2020/0211520 | A1 | 7/2020 | Rossum | |
| 2020/0213733 | A1 | 7/2020 | Rossum | |

OTHER PUBLICATIONS

Parker et al., "Dynamic FM synthesis Using a Network of Complex Resonator Filters," Proceedings of the Sound and Music Computing Conference 2013, 2013, Stockholm, Sweden, available at <https://tai-studio.org/img/portfolio/complexres/Parker_2013.pdf>, pp. 668-673.

Wikipedia: "State Variable Filter" [online], [retreived on Dec. 18, 2018], Retreived from the Internet: <https://en.wikipedia.org/wiki/State_variable_filter>, 2 pages.

Smith, Julius, "Digital State-Variable Filters," Center for Computer Research in Music and Acoustics (CCRMA), Department of Music, Stanford University, Stanford, California 94305 USA, Feb. 25, 2018, available at: <https://ccrma.stanford.edu/~jos/svf/svf.pdf>, 9 pages.

Wise, Duane, "The Modified Chamberlin and Zölzer Filter Structures," in Proceedings of the 9th International Conference on Digital Audio Effects, Montreal, Canada, Sep. 18-20, 2006; available at <https://pdfs.semanticscholar.org/413f/eafa02adfd32b273305206aa18f42d7dad5f.pdf>, DAFX-53-DAFX-56; (4 pages).

Janne808, "Zero State Machine—Mathematics, hacking and the daily struggle," Radio Free Robotron [online], Sep. 4, 2015 [retrieved on Jan. 27, 2020], Retrieved from the Internet: <URL:http://www.radiofreerobotron.net/blog/2015/09/04/how-to-zero-delay-state-variable-filter/>, 4 pages.

Simper, Andrew "Solving the Continuous SVF Equations Using Trapezoidal Integration and Equivalent Currents," Cytomic, [online], [retrieved on Jan. 27, 2020], Retrieved from the Intemet: <URL:https://cytomic.com/files/dsp/SvfLinearTrapOptimised2.pdf>, 32 pages.

Cytomic.com, "Technical Papers" [online], [retreived on Jan. 27, 2020], Retreived from the Internet: <https://cytomic.com/index.php?q=technical-papers>, 5 pages.

Massie, Dana, "Coefficient Interpolation for the Max Mathews Phasor Filter," (AES Convention Papers, 113rd Convention, 2012), 8 pages.

Rossum, Dave, "The 'ARMAdillo' Coefficient Encoding Scheme for Digital Audio Filters", IEEE ASSP Workshop on Applications of Signal Processing to Audio and Acoustics, Oct. 1991, 2 pages.

Rossum, Dave, "Making digital filters sound 'analog'", International Computer Music Association, vol. 1992, 1992, pp. 30-33.

Chowning, John, "The Synthesis of Complex Audio Spectra by Means of Frequency Modulation," Journal of the Audio Engineering Society, vol. 21, Issue 7; Sep. 1973.; pp. 526-534; available at: <https://web.eecs.umich.edu/~fessler/course/100/misc/chowning-73-tso.pdf>.

Wikipedia: "Ring Modulation" [online], [retreived on Dec. 18, 2018], Retreived from the Internet: <https://en.wikipedia.org/wiki/Ring_modulation>, 8 pages.

Synthesizeracademy.com, "Ring Modulator" [online], [retreived on Dec. 18, 2018], Retreived from the Internet: <http://synthesizeracademy.com/ring-modulator/>, 5 pages.

Wikipedia: "Oscillator Sync" [online], [retreived on Dec. 18, 2018], Retreived from the Internet: <https://en.wikipedia.org/wiki/Oscillator_sync>, 3 pages.

Keith McMillan Instruments, "Simple Synthesis: Part 7, Oscillator Sync | Keith McMillen Instruments" posted by Emmett Corman [online], [retreived on Dec. 18, 2018], Retreived from the Internet: <https://www.keithmcmillen.com/blog/simple-synthesis-part-7-oscillator-sync/>, 3 pages.

Brandt, Eli, "Hard Sync Without Aliasing",in Proceedings of International Computer Music Conference, Havana, Cuba, Oct. 26, 2001, available at <https://www.cs.cmu.edu/~eli/papers/icmc01-hardsync.pdf>; pp. 365-368.

"Pitch Detection Methods," Multimedia Systems Department, Gdansk University of Technology, [online], [retreived on Dec. 18, 2018], Retreived from the Internet: <https://sound.eti.pg.gda.pl/student/eim/synteza/leszczyna/index_ang.htm>, 7 pages.

Wikipedia: "Waveshaper" [online], [retreived on Dec. 21, 2018], Retreived from the Internet: <https://en.wikipedia.org/wiki/Waveshaper>, 3 pages.

Wikibooks: "Sound Synthesis Theory/Oscillators and Wavetables" [online], [retreived on Dec. 21, 2018], Retreived from the Internet: <https://en.wikibooks.org/wiki/Sound_Synthesis_Theory/Oscillators_and_Wavetables>, 7 pages.

Curtis Electro-Music Specialties, "CEM3340/3345 Voltage Controlled Oscillator" Datasheet; [online], [retreived on Jan. 27, 2020], Retreived from the Internet: <https://nebula.wsimg.com/1c34939ca17fdcf07c8ceee4661ba253?AccessKeyId=E68C2B1C2930EF53D3A4>, 6 pages.

Simper, Andrew "Solving the Continuous SVF Equations Using Trapezoidal Integration and Equivalent Currents," Cytomic, [online], [retrieved on Jan. 27, 2020], Retrieved from the Internet: <URL:https://cytomic.com/files/dsp/SvfLinearTrapOptimised2.pdf>, 32 pages.

"Ring Modulation", Trillian, <URL:https://support.spectrasonics.netlmanual/Trilian/1.5/en/topic/ring-modulation>, Dec. 15, 2020, 5 pages.

"The Korg Monologues—Part 8-Sync and Ring", AutomaticGainsay, YouTube, <URL:https://www.youtube.com/watch?v=HeBVFYZ6CII>, Feb. 10, 2017, 1 page.

* cited by examiner

MUTATING SPECTRAL RESYNTHESIZER SYSTEM AND METHODS

CROSS-REFERENCE TO RELATED APPLICATION(S)

This non-provisional application claims benefit to U.S. Provisional Patent Application Ser. No. 62/965,042, filed on Jan. 23, 2020, entitled "Mutating Spectral Resynthesizer System and Methods" to which this application claims priority and is hereby incorporated by reference herein in its entirety, including all references and appendices cited therein, for all purposes.

FIELD

The present disclosure is directed to systems and methods for extracting pitch features from audio and using these pitch features to synthesize audio that can be used to accompany the audio or be used for other musical and audio effects.

BACKGROUND

One of the challenges of synthesizing audio to accompany audio or music is the extraction in real time of pitch features and to synchronize the synthesis with the tempo of the audio input. In prior art systems, real-time effects processing of the incoming audio typically generates output that is a distortion of the incoming signal. These processes either will work entirely in the time domain, and therefore are unable to respond in a sophisticated manner to frequency domain elements of the signal, or will convert the incoming audio into the frequency domain, change the audio in the frequency domain, and then use an inverse transform, such as an Inverse Fast Fourier Transform to regenerate the audio. These systems have been limited to monophonic instruments (instruments capable of sounding only one musical note at a time) to detect a note and send this information off to a monophonic synthesizer. These systems have not worked well on polyphonic audio inputs such as a pop song, an orchestra, or natural sounds such as a wind blowing through trees with singing birds. Among the limitations of prior art frequency domain resynthesizing methods are latency and that their modifications of data may result in undesirable and objectionable audio artifacts.

What is needed is a system and process that does more than a simple one-to-one pitch detection and resynthesis. What is needed is systems and methods that can synthesize audio based on the audio pitch features and characteristics of an audio input acceptably in real-time. Further, what is needed is to be able to perform the analysis and synthesis synchronized with the tempo of the incoming audio.

SUMMARY

According to various embodiments, the present technology is directed to a method of generating audio having attributes of an incoming audio stream. The method starts with receiving a digital audio input stream generated from sampling an analog audio source. The audio data is continually buffered in a computer memory. A segment of buffered data is then analyzed upon receiving an analysis trigger clock. The analysis includes performing a frequency transform on the most recent segment of digital audio data into a frequency representation. The result is a spectrum. Further, a frequency transform on a sub-segment portion is performed. The resulting transform is called a fast spectrum.

Next a blended spectrum is formed by using the lower frequencies from the spectrum and the higher frequencies of the fast spectrum. Then either the spectrum or the blended spectrum is spectrally integrated generating an integrated spectrum. The integrated spectrum is processed to find the peak frequencies in the spectrum and the strength or gain of these peaks. The peak frequencies detected are resolved to more accurately determine their frequency and gain. This information is placed into a peaks array of frequencies and gains.

Next, audio is synthesized from a number of oscillators and the parameters determined during analysis. The synthesis is performed repetitively upon receiving an analysis clock. First, a number of digital oscillators are configured with the associated frequency parameters and gain parameters from the peaks array. Each of the number of selected oscillators generate mixed oscillator output at a frequency and gain specified in the peaks array. These oscillator outputs are summed together thereby generating synthesized audio. The synthesized audio can then be output to a digital-analog converter to generate an analog audio output.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

The following detailed description includes references to the accompanying drawings, which form a part of the detailed description. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and electrical changes can be made without departing from the scope of what is claimed. The following detailed description is, therefore, not to be taken in a limiting sense, and the scope is defined by the appended claims and their equivalents.

One or more embodiments of the present disclosure include methods and systems for a mutating spectral resynthesizer. Various embodiments of the present technology include the use of new techniques and the use of certain known techniques in unique ways. For example, according to one aspect, an example method of the present technology is specifically intended to produce interesting, musically useful results, as the method does not use any of the actual input signal in its resynthesis. The resynthesis is informed by the input signal, and one may stretch only slightly to say that the analyzer section extracts features from the input signal, then uses these features to synthesize new, but musically related, output.

Figure 1:
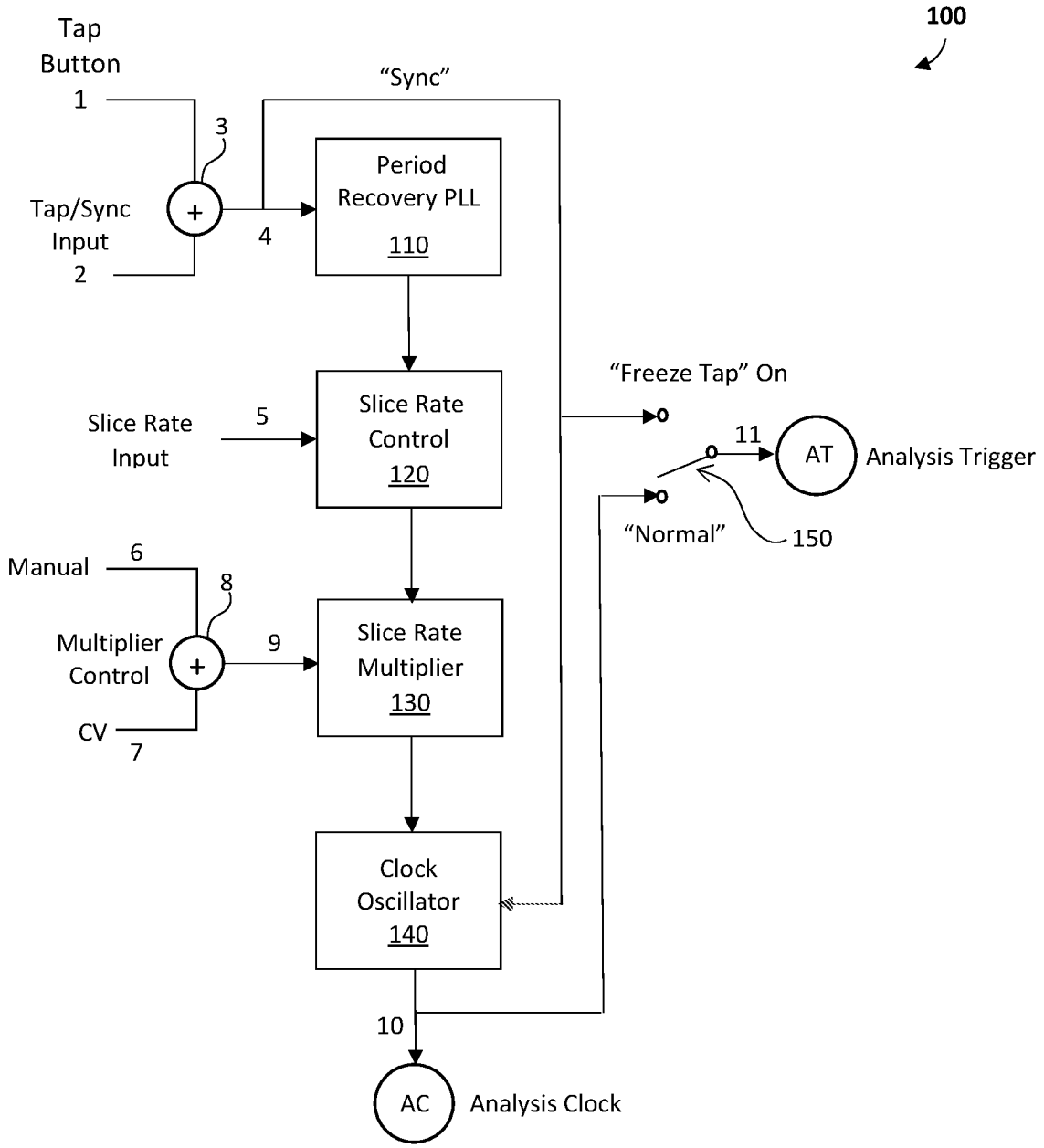
FIG. 1 is an example clocks section of the flow diagram for various embodiments of the present technology.
Figure 2:
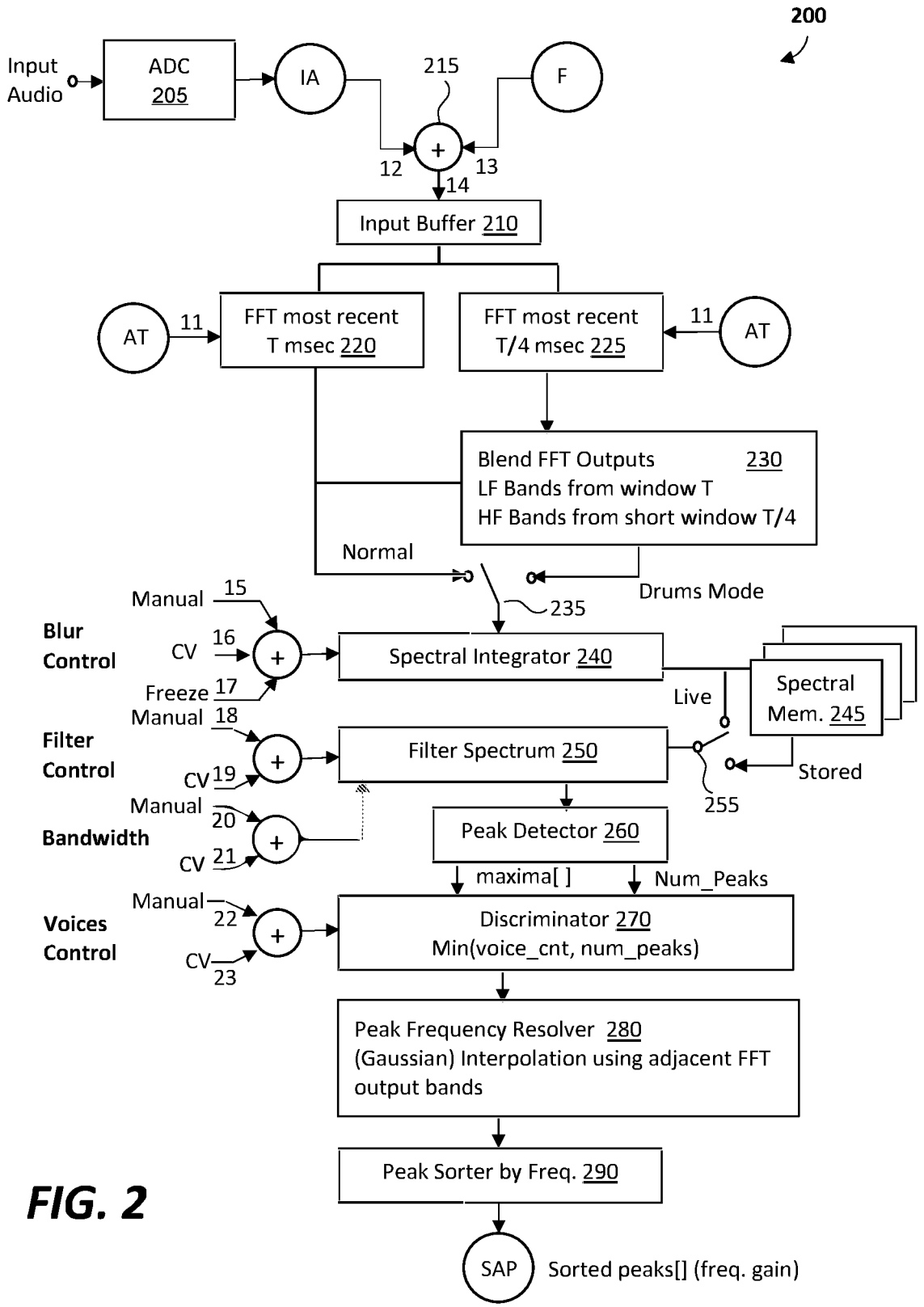
FIG. 2 is an example analyzer flow diagram for various embodiments of the present technology.
Figure 3:
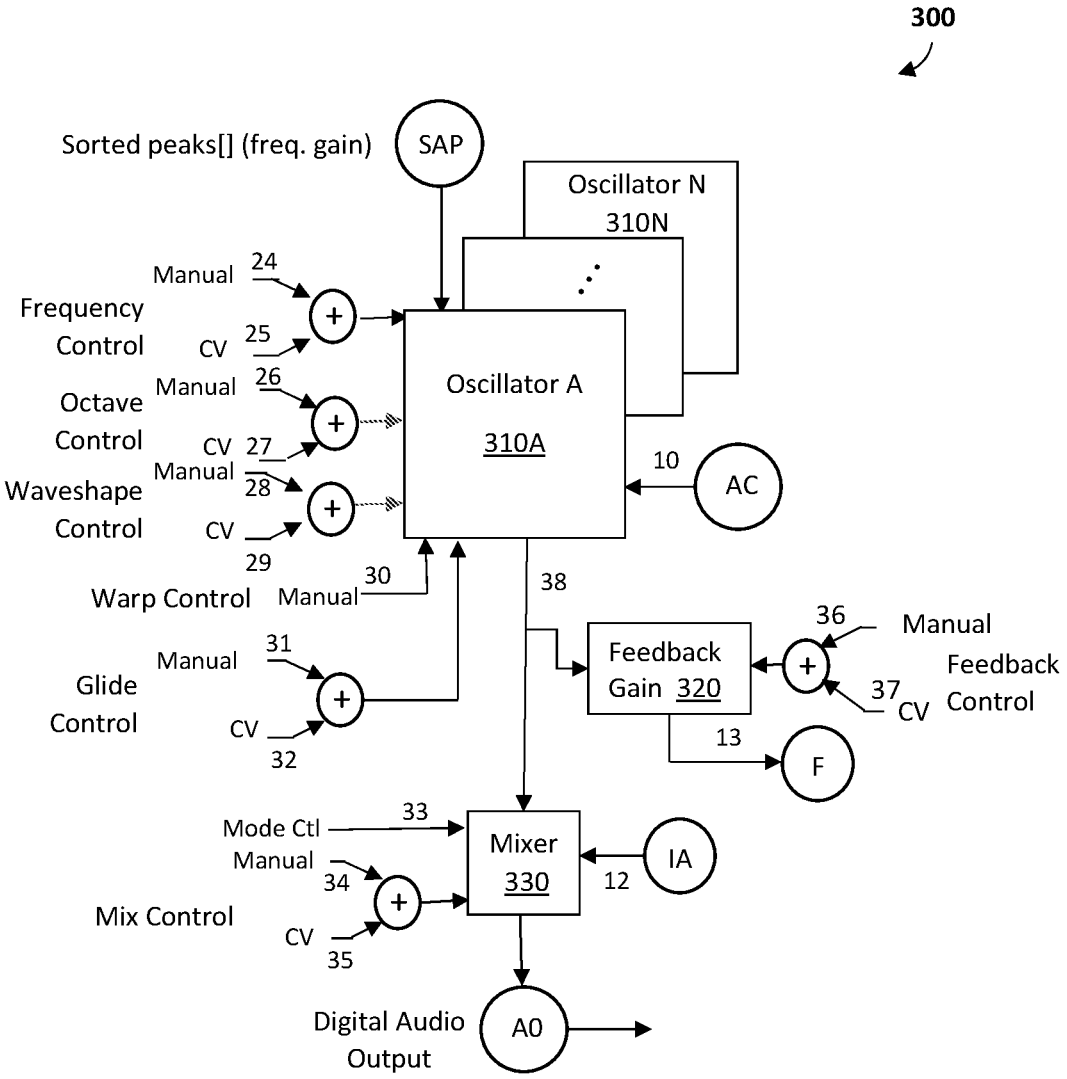
FIG. 3 is an example synthesizer flow diagram for various embodiments of the present technology.

FIG. 1, FIG. 2, and FIG. 3 illustrates example sections of a flow diagram of the processing step and methods for example embodiments.

Clock Section

Referring to FIG. 1 is an example clocks section 100 of the flow diagram for various embodiments of the present technology. The example clock section 100 is also referred to as "Panharmonium Clocks" section. The example Panharmonium Clocks section 100 of the flow diagram in the example in FIG. 1 includes a number of control or configuration inputs.

The tap button 1 can come from a mechanical tap button and is coupled to a period recovery phase lock loop (PLL) 110. This tap button 1 and can be used to sync the clock oscillator, and generate an analysis trigger 11. A user pressing this button can use it to set a tempo by tapping the tap button 1 at a tempo rate. The tap button 1 can also be asserted when there is a change in the input music.

The tap/sync input 2 can come from an input jack. This input can be from a musical instrument digital interface (MIDI) device or other electronics that generate a tempo related or unrelated to the audio or music being input into the system.

The tap button 1 and tap/sync input 2 can be combined with a logical OR 3 generating an output 4 used as an input for the period recovery PLL 110, a sync input for the clock oscillator 140, and can be used to freeze the analysis trigger 11.

The slice rate input 5 controls the slice rate control 120. The input can be a selector switch which generates a voltage level for each selector position. This can be read by hardware and translated into a discrete value and used by a processor to control the slice rate.

The slice rate control 120 can run independent of the PLL 110 or be driven by the PLL 110. For example, the PLL 110 may be tracking the tempo of a tap/sync input 2, or a tempo tapped into the tap button 1 by a user. By using the PLL, the analysis and synthesized audio follows along with the tempo of the tap/sync input 2 or a tempo tapped into the tap button 1.

A slice is the time period used to process input audio but the slice rate can be faster, because overlapping slices can be use. Sampling is usually performed at a fixed rate, and a slice can be around 88 milliseconds. The slice period can vary from a few milliseconds (less than a slice) to many seconds, to infinite which freezes the system on a slice.

The slice rate control 120 generates the slice clock that is provided as an input to the Slice Rate Multiplier 130.

The slice rate multiplier 130 expands the time between slices. If the slices are every 88 milliseconds, a multiplier of two will generate a clock rate at 196 milliseconds. The slice rate multiplier 130 can be controlled by a multiplier control input 9. Either manually generated input 6 or a control voltage input 7 is logically OR 8 together and represents a multiplier control input 9 that is used by the slice rate multiplier 130 to expand the time between slices. Preferably, the multiplier is an integer number.

The output of the slice rate multiplier 130 is used as input to a clock oscillator 140 that generates a pulse train which specifies the analysis clock 10 period and the analysis trigger 11. The clock oscillator can accept a sync input 4 which resets the counter used to generate the output pulse train from the clock oscillator 140. The sync input is generated as a combined sync output 4 of logical OR 3 of tap button 1 and tap/sync input 2.

The output of the clock oscillator 140 is used as an output signal "Analysis Clock" for use in the Synthesis Section (in FIG. 3) and can be used as the "Analysis Trigger" in the Analysis Section (FIG. 2).

To provide the capability to freeze the analysis section 200 and thereby have the synthesis section 300 reuse the parameters and characteristics of the analysis section 200, a freeze clock switch 150 enables the selection of sync output 4 when "freeze tap on" is selected, or use the analysis clock 10 when Normal is selected as the analysis trigger supplied to the analyzer section 200 of FIG. 2. Although not shown in the example in FIG. 1, the "Analysis Trigger" signal may be made available to an output jack, for synchronization use externally.

Analyzer Section

FIG. 2 is an example analysis section 200 of the flow diagram and processes for various embodiments of the present technology. The example analysis section 200 is also referred to as the "Panharmonium Analyzer" section. The analysis section 200 processes an audio signal and extracts pitch and provides other transformations of the pitch information which are then used by the synthesis 300 of FIG. 3 to generate a synthesized audio.

First, a digital audio stream is provided to the system. The source of the digital audio stream can be an analog audio input signal that is digitized with an analog to digital converter 205 outputting a digital audio data 12 and is also referred to herein as "Incoming Audio" signal. The digital audio data 12 can be mixed with a feedback 13 generated during synthesis of the audio output. The combining 215 of the digital audio data 12 with the feedback 13 can be performed using vector addition.

The mixed digital audio 14 is continually stored in the circular input buffer 210. The buffer can be in computer processor memory or specialized hardware that is memory mapped to give the processor access to the input buffer data 210. Preferably, the input buffer 210 is as large as needed for the transform size but larger and smaller buffers sizes are contemplated.

Periodically or asynchronously, at times determined by signal "Analysis Trigger" 11, a slice of data from the input buffer 210 is processed using a frequency transform, including but not limited to a Fourier transform, a Fast Fourier Transform FFT, or a discrete cosine transform, for producing a spectrum. The processing block 220 transforms the most recent T milliseconds of input buffer audio into the frequency domain. This data is also referred to as a segment of the input buffer. Preferably, the transform size is 2048, representing the processing of 2048 samples of audio data. In the shown example, the frequency domain signal is also referred to herein as "normal FFT". In this preferred embodiment, the value of T is approximately 88 milliseconds; other values of T might be chosen for a different tradeoff of low frequency performance vs. latency and transient response. A larger FFT provides better frequency resolution at lower frequencies but increases the latency of the FFT output because more data has to be read in and more time is required to process the larger FFT.

While the Fast Fourier Transforms is disclosed in the preferred embodiment, other transforms are contemplated. These include but are not limited to the Discrete Cosine Transform.

Additionally, either periodically or asynchronously, at times determined by signal "Analysis Trigger" 11, an FFT 225 is generated using the most recent T/X milliseconds of the input buffer audio. The value of X is greater than 1 and preferably is 4. This equates to a 512 data point transform though smaller or larger transform sizes are contemplated. In practice, this transform uses the same number of points as processing block 220, but all but T/X points are zeroed. This simplifies subsequent blending because the bin size of both transforms is the same.

In a processing step 230, the FFT outputs from the large FFT of processing block 220 and the small FFT 225 are blended. Low Frequency bands from the large transform are blended with the results from the small FFT 225. This forms a blended spectrum which is also referred to as using the "Drums Mode".

Next, either the spectrum or the blended spectrum is selected by logical switch 235 for further processing. Depending on an indication provided to the analysis section 200, a logical switch 235 passes either the spectrum or blended spectrum for further processing.

Optionally, in the next processing module or step, a spectral integrator module 240 blurs either the spectrum or blended spectrum. The spectral integrator module is controllable from a "Blur" input that originates from a manual control 15, a blur control voltage from a control voltage input (CV) 16, or a "Freeze" input 17 from a pushbutton.

The "Blur" control input 15, the blur control voltage 16, and the "Freeze" input 17 generate a parametric signal to control the coefficient(s) of a vector integrator used in a Spectral Integrator module 240 in the frequency domain with either the spectrum or the blended spectrum. The blur is a spectral lag that controls how quickly the spectrum changes. Maximum Blur will freeze the spectrum, which is the equivalent to asserting the freeze button. This integrated signal is also referred to herein as "Live Spectrum". With the "Blur" parameter at maximum, or with the "Freeze" button held, an integrator coefficient multiplies all new spectral input by zero, and the integrator feedback by 1, therefore the integrated spectrum is effectively frozen.

The depth of the blurring is controlled by the Blur control, which determines the coefficients of a 2D lowpass filter. At minimum setting, the output of the integrator is purely the input signal, and there is no blurring. At maximum setting, the output of the integrator is purely the accumulated spectrum, implementing the "freeze" function—the frozen spectrum.

The Blur can be implemented as a two dimensional exponential moving average lowpass filter on the incoming spectral data. That is to say, from analysis frame to frame, each band (bin) of the FFT has its output magnitude integrated with the previously accumulated magnitude of that band. This implements a spectral blurring in time, but not in frequency.

The process can include, at user determined times, storing one or more snapshots of this integrated signal into persistent digital memories 245 "Stored Spectra" (Spectral memories). A user can control the selection step 255 between a stored spectrum and a live spectrum.

The integrated spectrum can be processed by a filter spectrum module 250 or step. The filter spectrum module 250 is configured to accept control from a combined manual control 18 and external control 19 voltage inputs to determine a parameter "Bandwidth" for a filter stage. Note the Bandwidth can go negative, to allow for band reject style filtering.

The filter spectrum module 250 can be controlled by a number of user inputs including the type of filtering, the center frequency of the filter, and the bandwidth of the filter. In the shown embodiment, inputs 18-21 control the filter spectrum module 250. These can be control switches or CV inputs that result in a corresponding selection of filter type, the center frequency of the filter, or the bandwidth of the filter.

The filter spectrum module 250 can filter the frequency domain input signal (either a "Stored Spectrum" or the "Live Spectrum" as selected) by modifying the frequency domain signal's band gains, using the Center Frequency and Bandwidth parameters according to their traditional interpretations. Although not shown in the example in FIG. 2, there are other possible ways to control this filter, such as control of the low and high frequency band edges. One skilled in the art of digital signal processing would know how to design a filter to provide the filter spectrum module 250.

In one embodiment, the filtering is performed in the frequency domain but if a non-frequency domain type transform is used, the filtering appropriate for that domain can be used. The current embodiment uses a rectangular windowing, and effectively "infinite" slope so that when operating as a band pass filter, frequencies outside of the band are rejected completely, and when operating as a band reject filter, frequencies inside the band are rejected completely. Other embodiments could use more traditional filter response shapes, or more radical shapes, as the filtering is performed in the frequency domain on the spectral magnitude data. Thus, band-by-band (bin-by-bin) modification of the transform output magnitude is possible.

Next a peak detector 260 processing module analyzes the filtered spectrum to find the spectral characteristics. The filtered spectrum is processed to find all of the peaks and their associated strength (gain). In one embodiment, a peak is a local maxima having a magnitude above the local noise floor. The local noise floor is preferably −50 dB but higher and lower floors are contemplated. The frequencies of all the local maxima are stored in an array. Further, a count of the number of maxima, also referred to as "NUM_PEAKS", is saved.

The discriminator processing module 270 can accept combined manual control and external control voltage inputs to determine a number "VOICE_COUNT", the maximum number of synthesis voices desired by the user. The size of the array of maxima is reduced to the smaller of NUM_PEAKS or the VOICE_COUNT, which can be a user input 22 or a parametric input that is mapped to a VOICE_COUNT.

In the Peak Frequency Resolver processing module or step 280, for the selected number of frequency maxima the frequencies are resolved by using inter-band interpolation within the FFT frequency domain representation, and a PEAKS array is generated where each element contains an accurate frequency and gain, and the array size is made available as "PEAK_COUNT". A Gaussian interpolation using adjacent FFT bands can be used in the interpolation.

In the Peak Sorter 290 module or step, the array of discriminated frequencies and gains are sorted by frequency from low to high. This is the information used by the Synthesizer Section (see FIG. 3).

Synthesizer

FIG. 3 is an example synthesis section 300 flow diagram (which may also be referred to herein as the synthesis section) for various embodiments of the present technology. The example synthesis section 300 is also referred to as "Panharmonium Synthesizer" section.

The synthesis section 300 uses pitch parameter characteristics, identified by the analysis section 200 through a transform, to generate synthesized audio output. These pitch parameters, as discussed in the analysis section 200 of FIG. 2, can have different attributes applied to the pitch characteristics. As discussed above, these can include blurring the frequencies from analysis to analysis, shaping the spectrum by filtering the spectrum, and controlling the number of peak frequencies (voices) used in the synthesis of the audio.

A unique aspect of the synthesis section 300 is that a fixed number of oscillators 310A-310N, where "n" corresponds to the PEAK_COUNT, are used to generate their synthesized audio output 38. Prior art synthesizers would use modified FFT spectra and then perform an inverse FFT (IFFT) to generate the output. The prior art process increases the delay between the analysis and the output. This can be a problem when it is desired for the system to track changes in tempo and pitch characteristics in real time. Furthermore, the use of an IFFT is limited to sine waves, which can introduce undesirable artifacts.

Further, the synthesis section 300 can also impart new characteristics to identified peaks (pitches) of the analyzed audio. The oscillators 310A-310N can shift the frequency parameters, shift the pitch by octaves, use different waveforms by the oscillators, spectrally warp the frequencies, and control gliding between the frequencies. Further, the synthesis section 300 can provide feedback 13 to the digital audio data 12 and mix the synthesized audio output 38 with the digital audio data 12.

All the new characteristics can be user controlled. The synthesis section 300 can have control inputs over various oscillatory parameters including the frequency of the oscillator, shifting octaves, changing the waveforms being generated by the oscillator, warping the frequencies, and gliding between the frequencies. The inputs can be user controlled through, but not limited to a potentiometer, or an external control voltage. This control information can be read off a hardware interface by a computer and converted into a digital value used in the synthesizer processing modules.

All or a subset of the oscillators modules 310A-310N are each configured to generate an output, all of which are summed together forming the synthesized audio output 38. The number of oscillators modules 310A-310N that are programed depends on the number VOICES selected. For the purposes of this disclosure, "N" represents the maximum number of oscillators supported by the system. The value "n" represents the number of voices selected which is the same as PEAK_COUNT. The discriminator processing module 270 finds the number of peaks in the transform up to the number of VOICES selected. If the number of peaks found is less than the number of VOICES selected, then the number of peaks found is the number of the oscillators 310A-310N enabled to generate a synthesized audio output 38.

The oscillators 310A-310N can have several user or control voltage (CV) inputs that can modify and configure the synthesized audio output 38. One parameter for configuring the oscillators 310A-310N is a FREQUENCY parameter. This parameter adjusts up and down the fundamental frequency of each active oscillator 310A-310N.

A combined manual control 24 and external control voltage (CV) 25 forms a parameter "FREQUENCY" which can be sampled at "Analysis Clock" 10 rate.

Another parameter for configuring the oscillators 310A-310N is an "OCTAVE" parameter. This parameter adjusts up and down the fundamental frequency of each active oscillator 310A-310N by a parameter specified number of octaves.

A combined manual control 26 and external control voltage (CV) 27 forms a parameter "OCTAVE" which can be sampled at "Analysis Clock" 10 rate to form parameter "OCTAVE".

Another parameter for configuring the oscillators 310A-310N is a "WAVESHAPE" parameter. This parameter changes the waveshape generated by each active oscillator 310A-310N. The possible waveshapes include but are not limited to sine, crossfading sine, crossfading sawtooth, pulse, triangular, and sawtooth.

A combined manual control 28 and external control voltage (CV) 29 to form a parameter "WAVESHAPE" which can be sampled at "Analysis Clock" 10 rate to form parameter "WAVESHAPE".

Another parameter for configuring the oscillators 310A-310N is a "WARP" parameter. This parameter expands outwards or collapses inward toward a single frequency point, the frequencies generated by each active oscillator 310A-310N, while maintaining their relative positioning.

The manual control 30 forms a parameter "WARP". The manual control 30 can be sampled at "Analysis Clock" 10 rate to form parameter "WARP."

Another parameter for configuring the oscillators 310A-310N is a "GLIDE" parameter. Because of the use of discrete oscillators to render the synthesized audio output 38, the rate at which each oscillator's frequency changes, on an analysis frame-to-frame basis, can be slewed (ramped). The Glide Control sets the slewing rate. With the glide setting at a minimum, the rate of change is instantaneous. With the glide setting at a maximum, the slew time can be infinite, and the oscillator's frequencies are effectively frozen. Note that this gliding effect would be difficult or impossible using an inverse FFT for its output rendering, especially for complex, multi-frequency input spectra.

The combined manual control 31 and external control voltage (CV) 32 to form a parameter "GLIDE" which can be sampled at "Analysis Clock" 10 rate to form parameter "GLIDE".

An additional feature that can be provided by the oscillators 310A-310N is the feature of crossfading waveshapes. This feature is provided by providing a second complementary oscillator that may be provided for each primary oscillator 310A-310N, allowing the currently playing oscillator to fade out at its current frequency at a rate determined by "Analysis Clock" 10 and its incoming complement to fade in at its new frequency at a rate determined by "Analysis Clock" and thereby provide smooth output waveform.

The analysis 200 can include an Anti-Alias filter for each oscillator to prevent aliasing using techniques well known in the art. (Not shown in the example in FIG. 3)

The feedback gain module 320 scales the synthesized audio output 38 and provides a feedback 13 that can be mixed with digital audio data 12. The feedback gain module 320 can be configured to accept a combined manual control 36 and external control voltage 37 to form parameter "FEEDBACK_GAIN." The FEEDBACK_GAIN parameter is used to control the gain on synthesized audio output 38 in providing feedback 13. In example embodiments, an automatic gain control (AGC) limiter (not shown in the example in FIG. 2 or 3) can be provided in the feedback path, to prevent runaway gain.

The Mixer module 330 can be configured to accept a combined manual control 34 and external control voltage (CV) 35 to form parameter "MIX". The MIX parameter is used to control the ratio at which the synthesized audio output 38 and the digital audio data 12 are mixed.

In the Mixer module 330, the synthesized audio output 38 is mixed with digital audio data 12. The signals "Synthesis" and "Incoming Audio" are combined by scaling and summation according to equal power law as determined by parameter "MIX", into an audio output signal or "Audio Output".

The audio output signal can be loaded into a circular buffer (not shown in the example in FIG. 3). The data in the circular buffer can be sent to a digital to analog converter (DAC), (not shown) and make the analog signal available as output from the device.

Alternative Implementations

Although in example embodiments the disclosure shows monophonic (as opposed to stereophonic) processing, i.e., a single channel, the present technology is not so limited. That is, it would be clear to one of ordinary skill in the art that the present technology can be extended to perform stereo or multi-channel processing.

An alternative embodiment that was coded and tested is an alternate assignment algorithm in the Discriminator section (peak picker) to ensure that no more than a certain number of frequencies were used within each octave (i.e., limiting the number of peaks within an octave). This can be implemented to prevent frequency clustering, and providing a smoother result when processing broadband music signals.

In some other embodiments, an alternate assignment algorithm in the Discriminator section (peak picker) keeps the selected peaks apart based on the ratio of the adjacent selected frequencies, providing musical "open voicing". This ratio may be set by a parametric control called "Spacing".

As musical signals tend to have more energy in the low frequencies, pre-emphasizing the input high frequencies via equalization can be used in some embodiments to help bias the analyzer to include more high frequency information in the peak picking.

Further regarding the Drum mode:

In "normal" mode, a fairly long input window (many tens of milliseconds) to the FFT may be used in order to properly capture and resolve the lowest frequencies with stability. These long windows, while providing low frequency support, can do so at the expense of transient response. Using shorter input windows to the FFTs can destroy the ability to resolve the low frequencies with any accuracy or stability.

In various embodiments, this problem is solved by providing improved transient response for percussive signals while not showing embarrassing low frequency performance, was to form a hybrid window, by doing 2 separate FFTs, with different input signals, and combining the results.

In some embodiments, the first windowing and FFT was the standard (long) length window of "T" milliseconds, and the standard FFT size.

While many choices were available for the second, transient biased, transform, for ease of implementation, certain embodiments use the standard FFT size, but a custom windowing. This window was a Hann shape, covering the most recent ¼ times "T" milliseconds, and a complete zeroing of the later ¾ times "T" milliseconds. This windowing provided much improved transient response, albeit with poor low frequency performance.

To address this, the next step was to combine the transform outputs into one spectrum in some example embodiments. A crossover frequency of approximately 1 kHz is used in some example embodiments. For the example embodiments, first, the lower bins of the first FFT result were copied into the result. Second, the higher bins of the second transform were copied into the result. Finally, a crossfading of the bins around the crossover frequency was performed. This resulted in stable low frequency performance, improved high frequency transient response, with negligible to slight anomalies in the crossover region, a good compromise for the intended input signals in the Drums mode.

Regarding another alternate implementation/embodiment, because for various embodiments the output is newly synthesized from information gleaned from the input FFTs, the (copied) time domain input buffer can be freely destroyed in gleaning said information. In this case, in order to shorten the time window for the high frequencies while maintaining the long window for the lows, a dynamic time domain low pass filter was used on the input buffer to the FFT, with the filter cutoff frequency quickly (mere tens of milliseconds) swept from high to low across the length of the input buffer. Sweeping the cutoff frequency of the filter in the right direction was important, in order to preserve the most recent high frequency input. The result was an effectively shorter time window for high frequencies, medium length for the middle frequencies, and full length for the lowest frequencies. The FFT was performed after the filtering. The time domain input buffer was destroyed, but it would have been abandoned anyway. For this alternative implementation/embodiment the results were similar to the excellent results from other embodiments.

Feedback

A feedback path in audio processing systems, especially where a processing delay is involved, is not uncommon, e.g. Echo, Automatic Double Tracking, Flanging, etc.

The feedback path in various embodiments of the present technology is novel at least because, while the output signal is related to the input signal, none of the actual input signal, filtered or otherwise, is used in the feedback path. The signal that is being fed back and to the input has been synthesized anew, from parametric features extracted from the input signal.

Further, there is a limiter (AGC) built into the feedback path in various embodiments, clamping the maximum feedback amplitude, so that infinite recirculation is possible without the potential for runaway gain, producing musically pleasing results. (To streamline the flow diagram and for clarity, the limiter is not shown).

Aspects of certain embodiments are summarized in outline form below.

An alternative implementation A can include Spectral Analysis; Peak Picking; Extracting peaks; Modifying the result; and Resynthesis using oscillators rather than inverse transform.

An alternative Implementation B provides, a spectral Analysis where a window is located rhythmically or on a triggered basis in time, for example to a musical beat (according to one of the novel aspects); Peak Picking; Extracting peaks; Modifying the result; and Resynthesis.

An alternative Implementation C can include Spectral Analysis; Peak Picking; Extracting peaks; Modifying the result specifically by sorting the peaks so that pitch glides effectively; and Resynthesis using oscillators rather than inverse transform.

In some embodiments, real-time (Voltage) control of analysis band edges for the FFT analyzer is included to effectively dynamically filter the analyzed spectrum.

Some embodiments include Implementation A wherein the oscillators are non-sinusoidal.

According to another aspect, for various embodiments the analysis can be frozen, stored and recalled, and modified before resynthesis.

According to another aspect, for various embodiments the modification can be one of several types, e.g., warp, blur, glide, oscillator count, to name just several non-limiting examples.

According to another aspect, for various embodiments can include feedback from the resynthesis output to the analysis input.

Figure 4:
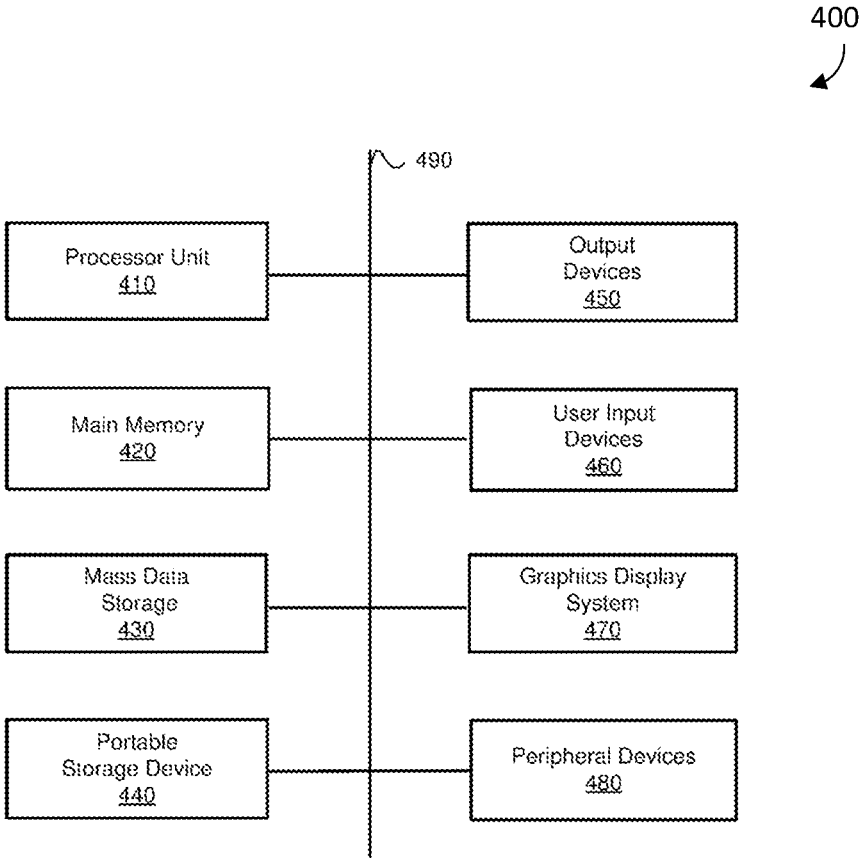
FIG. 4 is a schematic diagram of an example computer device that can be utilized to implement aspects of the present technology.

FIG. 4 illustrates an exemplary computer system 400 that may be used to implement various source devices according to various embodiments of the present disclosure. The computer system 400 of FIG. 4 may be implemented in the contexts of the likes of computing systems, networks, servers, or combinations thereof. The computer system 400 of FIG. 4 includes one or more processor unit(s) 410 and main memory 420. Main memory 420 stores, in part, instructions and data for execution by processor unit(s) 410. Main memory 420 stores the executable code when in operation, in this example. The computer system 400 of FIG. 4 further includes a mass data storage 430, portable storage device 440, output devices 450, user input devices 460, a graphics display system 470, and peripheral devices 480.

The components shown in FIG. 4 are depicted as being connected via a single bus 490. The components may be connected through one or more data transport means. Processor unit(s) 410 and main memory 420 are connected via a local microprocessor bus, and the mass data storage 430, peripheral devices 480, portable storage device 440, and graphics display system 470 are connected via one or more input/output (I/O) buses.

Mass data storage 430, which can be implemented with a magnetic disk drive, solid state drive, or an optical disk drive, is a non-volatile storage device for storing data and instructions for use by processor unit(s) 410. Mass data storage 430 stores the system software for implementing embodiments of the present disclosure for purposes of loading software into main memory 420.

Portable storage device 440 operates in conjunction with a portable non-volatile storage mediums (such as a flash drive, compact disk, digital video disc, or USB storage device, to name a few) to input and output data/code to and from the computer system 400 of FIG. 4. The system software for implementing embodiments of the present disclosure is stored on such a portable medium and input to the computer system 400 via the portable storage device 440.

User input devices 460 can provide a portion of a user interface. User input devices 460 may include one or more microphones; an alphanumeric keypad, such as a keyboard, for inputting alphanumeric and other information; or a pointing device, such as a mouse, a trackball, stylus, or cursor direction keys. User input devices 460 can also include a touchscreen. Additionally, the computer system 400 as shown in FIG. 4 includes output devices 450. Suitable output devices 450 include speakers, printers, network interfaces, and monitors.

Graphics display system 470 include a liquid crystal display (LCD) or other suitable display device. Graphics display system 470 is configurable to receive textual and graphical information and process the information for output to the display device. Peripheral devices 480 may include any type of computer support device to add additional functionality to the computer.

The components provided in the computer system 400 of FIG. 4 are those typically found in computer systems that may be suitable for use with embodiments of the present disclosure and are intended to represent a broad category of such computer components that are well known in the art. Thus, the computer system 400 of FIG. 4 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, ANDROID, IOS, CHROME, TIZEN and other suitable operating systems.

The processing for various embodiments may be implemented in software that is cloud-based. The computer system 400 may be implemented as a cloud-based computing environment. In other embodiments, the computer system 400 may itself include a cloud-based computing environment. Thus, the computer system 400, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices.

The cloud may be formed, for example, by a network of web servers that comprise a plurality of computing devices, such as the computer system 400, with each server (or at least a plurality thereof) providing processor and/or storage resources. These servers may manage workloads provided by multiple users (e.g., cloud resource customers or other users).

While the present technology is susceptible of embodiment in many different forms, there is shown in the drawings and herein described in detail several specific embodiments with the understanding that the present disclosure is to be considered as an exemplification of the principles of the technology and is not intended to limit the technology to the embodiments illustrated.

What is claimed is:

1. A method of audio sound generation, comprising:

receiving a digital audio input stream;

buffering a segment of the digital audio input stream;

analyzing the segment upon receiving an analysis trigger, wherein the analysis comprises:

performing a transform on the segment, thereby generating a spectrum;

finding a number of peak frequencies in the spectrum and a number of associated gains; and resolving the number of peak frequencies thereby generating a peaks array comprising a number of associated frequency parameters and a gain parameter; and synthesizing audio upon receiving an analysis clock comprising steps of:

configuring a number of digital oscillators with associated frequency parameter and gain parameter from the peaks array;

generating a number of oscillator outputs subject to their configuration; and combining each of the number of oscillator outputs thereby generating synthesized audio; and converting the synthesized audio to an analog audio output.

2. The method of claim 1, wherein the analysis is started by the analysis trigger and wherein the analysis clock and the analysis trigger are the same.

3. The method of claim 1, further comprising the step of spectrally integrating the spectrum.

4. The method of claim 1, wherein the transform is one of a Fourier transform, Fast Fourier Transform, or a discrete cosine transform.

5. The method of claim 4, wherein the analysis clock is phased locked to a user adjustable multiple of a tap input.

6. The method of claim 1, wherein the digital input audio stream includes a scaled feedback of a synthesized output and the synthesized audio is mixed with a scaled audio input.

7. The method of claim 1, wherein the digital oscillators are selectable waveform generators configured to generate a sine wave, crossfading sine wave, a crossfading sawtooth, a pulse, triangle wave, a ramp, a sawtooth, and a square wave.

8. The method of claim 1, further comprising a step of applying a filter to the integrated spectrum, wherein the filter has a center frequency, a bandwidth, and a filter shape.

9. The method of claim 1, further comprising the step of adjusting the frequency parameter for each of the oscillators, wherein the adjustment is under user control.

10. The method of claim 1, further comprising modifying a synthesizer output by one or more octaves.

11. The method of claim 1, further comprising modifying a synthesizer output with glide.

12. A device for audio sound generation, comprising:

a processor;

an input buffer coupled to the processor;

an analog to digital converter coupled to the input buffer and configured to write digitized audio data into the input buffer; and a memory for storing executable instructions, the processor executing the executable instructions to:

read a buffered segment of audio data from the input buffer upon receiving an analysis trigger; and analyze an audio input upon receiving the analysis trigger, wherein the analysis comprises:

performing a transform on the buffered segment, thereby generating a spectrum and performing a transform on a portion of the buffered segment generating a fast spectrum;

blending lower frequencies of the spectrum with higher frequencies of the fast spectrum, thereby generating a blended spectrum;

spectrally integrating the spectrum or the blended spectrum thereby generating an integrated spectrum;

finding a number of peak frequencies in the spectrum and a number of associated gains; and resolving the number of peak frequencies thereby generating a peaks array comprising a number of associated frequency parameters and associated gain parameters;

synthesizing audio upon receiving an analysis clock comprising steps of:

configuring a number of digital oscillators with associated frequency parameters and associated gain parameters from the peaks array; and combining each of a number of oscillator outputs thereby generating synthesized audio; and converting the synthesized audio to an analog audio output.

13. The device of claim 12, wherein the analysis is restarted by the analysis trigger.

14. The device of claim 12, wherein the analysis trigger and the analysis clock are the same.

15. The device of claim 12, further comprising mixing an audio output stream with the synthesized audio.

16. The device of claim 15, wherein the analysis clock is phased locked to a user adjustable multiple of a tap input.

17. The device of claim 12, wherein the audio input stream includes a scaled feedback of the synthesized audio output.

18. The device of claim 12, wherein the digital oscillators are selectable waveform generators configured to generate a crossfading sine wave, a sine wave, a pulse train, a ramp wave, a triangle wave, a sawtooth wave, and a square wave.

19. The device of claim 12, further comprising the step of applying a filter to the integrated spectrum, wherein the filter has a center frequency, a bandwidth, and a filter shape.

20. The device of claim 12, further comprising the step of adjusting the frequency parameter for each of the digital oscillators, wherein the adjustment is under user control.

21. The device of claim 12, further comprising modifying a synthesizer output by one or more octaves.

22. The device of claim 12, further comprising modifying a synthesizer output with glide.

23. A method of audio sound generation, comprising:

receiving a digital audio input stream;

buffering a segment of the digital audio input stream;

analyzing the segment upon receiving an analysis trigger, wherein the analysis comprises:

performing a transform on the segment, thereby generating a spectrum and performing a Fast Fourier Transform on a segment portion, thereby generating a fast spectrum;

blending lower frequencies of the spectrum with higher frequencies of the fast spectrum, thereby generating a blended spectrum;

finding a number of peak frequencies in an integrated spectrum and a number of associated gains; and resolving the number of peak frequencies thereby generating a peaks array comprising a number of associated frequency parameters and associated gain parameters;

synthesizing audio upon receiving an analysis clock comprising steps of:

configuring a number of digital oscillators with an associated frequency parameter and gain parameter from the peaks array;

generating a number of oscillator outputs subject to their configuration; and combining each of the number of oscillator outputs thereby generating synthesized audio.

* * * * *